United States Patent [19]

Shindo et al.

[11] Patent Number: 4,886,559

[45] Date of Patent: Dec. 12, 1989

[54] HIGH STRENGTH TITANIUM MATERIAL HAVING IMPROVED DUCTILITY

[75] Inventors: Takuji Shindo; Hiromitsu Naito, both of Sagamihara; Masayoshi Kondo, Tokyo; Takashi Fukuyama, Chigasaki; Masaaki Koizumi, Chigasaki; Nobuo Fukada, Chigasaki, all of Japan

[73] Assignees: Nippon Steel Corporation; Toho Titanium Co., Ltd., both of Tokyo, Japan

[21] Appl. No.: 239,420

[22] Filed: Sep. 1, 1988

[30] Foreign Application Priority Data

Dec. 23, 1987 [JP] Japan ..... 63-326431

[51] Int. Cl.[4] ..... C22F 1/18

[52] U.S. Cl. ..... 148/421; 148/407; 148/11.5 F; 420/417

[58] Field of Search ..... 148/421, 407, 11.5 F; 420/417

[56] References Cited

FOREIGN PATENT DOCUMENTS 0587580 11/1959 Canada ..... 420/419

61-159563 7/1986 Japan .

OTHER PUBLICATIONS

Oikawa et al, in Strength of Metals & Alloys, vol. I, ed. McQueen et al, Pergamon, Oxford, 1986, pp. 601–606.

Japanese Industrial Standard (JIS) H4650 1975, pp. 487,488.

ASTM Standard B348, pp. 210–213.

*Primary Examiner*—Upendra Roy

*Attorney, Agent, or Firm*—Cushman, Darby & Cushman

[57] ABSTRACT

A high strength titanium material having an improved ductility, contains 0.1 to 0.8% by weight of iron, a required oxygen and nitrogen satisfying the following expression, in which an oxygen equivalence Q ranges from 0.35 to 1.0, $$Q=[O]+2.77\,[N]+0.1\,[Fe]$$

wherein

[O] is an oxygen content % by weight

[N] is a nitorgen content % by weight

[Fe] is an iron content % bt weight the rest being titanium and inevitable impurities, the oxygen and nitrogen exists as interstitial type solute elements in the titanium material, and the titanium material exhibits a two phase, an equiaxed phase or a lamellar phase, fine grain microstructure and has a tensile strength of 65 kgf/mm$^2$ or more, and a method for producing same.

3 Claims, 4 Drawing Sheets

HIGH STRENGTH TITANIUM MATERIAL HAVING IMPROVED DUCTILITY

BACKGROUND OF THE INVENTION

1. Field of the Invention

The present invention relates to a high strength titanium material having an improved ductility, and a method for producing same. More particularly, it relates to a high strength titanium material having an improved ductility which is obtained by defining the contents of nitrogen (N), iron (Fe), and oxygen (O) under a constant condition, and a method for producing same.

2. Description of the Related Art

Various alloys containing Al, V, Zr, Sn, Mo, etc., are well known as a high strength titanium alloy. Of these high strength titanium alloys, a Ti—6Al—4V alloy; a high strength titanium alloy having an improved toughness, for example, a Ti—5Al—2Sn—2Zr—4Cr—4Mo alloy; and a high strength titanium alloy having an improved ductility, for example, a Ti—15V—3-Cr—3Al—3Sn alloy, are well known. But, since such high strength and high toughness or ductility titanium alloys can be obtained only by a combination of special and strict controls of an alloy composition, and hot working or after a heat treatment, etc., the production method is complicated and costly.

If a high strength titanium material having substantially the same properties as that of the high strength titanium alloy can be obtained, without the necessity for a large amount of alloy composition and complicated treatments, such an alloy can be widely used in many fields.

Japanese Unexamined Patent Publication (Kokai) No. 61-159563 discloses a method for producing a forged material having a tensile strength of 80 kgf/mm$^2$ or more using an industrially pure titanium, by which the above-mentioned object is satisfied, and when crystal grains are refined by the above method, a high strength, pure titanium forged article having an improved ductility can be obtained. Nevertheless, this process requires a hot forming in which only a forging forming method, such as an upsetting or a heavy working, is used.

Therefore, a high strength titanium material which can be worked to form various shapes by using a usual production method, e.g., a plate rolling such as a hot strip rolling, a bar rolling, or a wire rolling without using the above-mentioned special forming method has been developed. Accordingly, the present invention is related to a various-shaped article of a titanium material produced by the above-mentioned production methods. Particularly, the high strength titanium material produced by a bar rolling process will be explained hereinbelow.

Table 1 shows examples of the relevant Japanese Industrial Standard (JIS) and an ASTM Standard.

As shown in Table 1, the standard material for the highest strength industrially pure titanium is that of ASTM G-4, having a tensile strength of 56 kgf/mm$^2$ or more.

The N, Fe, and O, etc., shown in Table 1 are impurities, the upper limit of the content of which is defined. In producing a titanium material, the relationship between the contents of such elements and the mechanical property values, the relationship between metallurgical behavior of such elements and the microstructure, and further, the effects on the above-mentioned items of a heat treatment working condition during production must be clearly defined.

TABLE 1

| | Mechanical properties | | Chemical Composition (% by weight) | | | | | | |
|---|---|---|---|---|---|---|---|---|---|
| | Tensile Strength (min) kgf/mm$^2$ | Ductility (min) % | N (max) | C (max) | H (max) | Fe (max) | O (max) | Total Remaining Impurities (max) | Ti |
| JIS 1 | 28 | 27 | 0.05 | — | 0.015 | 0.20 | 0.15 | — | Rest |
| ASTMG-1 | 24.5 | 24 | 0.03 | 0.10 | 0.015 | 0.20 | 0.18 | 0.03 | " |
| JIS 2 | 35 | 23 | 0.05 | — | 0.015 | 0.25 | 0.20 | — | " |
| ASTMG-2 | 35 | 20 | 0.03 | 0.10 | 0.015 | 0.30 | 0.25 | 0.03 | " |
| JIS 3 | 49 | 18 | 0.07 | — | 0.015 | 0.30 | 0.30 | — | " |
| ASTMG-3 | 45.5 | 18 | 0.05 | 0.10 | 0.015 | 0.30 | 0.35 | 0.40 | " |
| ASTMG-4 | 56 | 15 | 0.05 | 0.10 | 0.015 | 0.50 | 0.40 | 0.40 | " |

SUMMARY OF THE INVENTION

The object of the present invention is to provide a high strength titanium material having an improved ductility, and having a high tensile strength of 65 kgf/mm$^2$ or more and a ductility of 10% or more.

Another object of the present invention is to provide a high strength titanium material having an improved ductility, which is suitable for a high tension bolt, anchor bolt, or a high tension wire, etc.

Still another object of the present invention is to provide a high strength titanium material having an improved ductility and having a high tensile strength of 75 kgf/mm$^2$ or more and a ductility of 10% or more.

According to the present invention, there is provided high strength titanium material having an improved ductility, containing 0.1 to 0.8% by weight of iron, a required oxygen and nitrogen satisfying a following expression, in which an oxygen equivalence Q ranges from 0.35 to 1.0.

$$Q = [O] + 2.77\,[N] + 0.1\,[Fe]$$

wherein

[O] is an oxygen content % by weight

[N] is a nitrogen content % by weight

[Fe] is an iron content % by weight the rest being titanium and inevitable impurities, said oxygen and nitrogen existing as interstitial type solute elements in the titanium material, and said titanium material exhibiting a two phase an equiaxed phase or a lamellar phase, fine grain microstructure and having a tensile strength of 65 kgf/mm$^2$ or more.

Further, according to the present invention, there is provide a method for producing a high strength titanium material having an improved ductility comprising the steps of:

preparing a titanium material containing 0.1 to 0.8% by weight of iron, a required oxygen and nitrogen satisfying the following expression, in which an oxygen equivalence Q ranges from 0.35 to 1.0, $$Q=[O]+2.77[N]+0.1[Fe]$$

wherein

[O] is an oxygen content % by weight

[N] is a nitrogen content % by weight

[Fe] is an iron content % by weight the rest being titanium and inevitable impurities;

heating said titanium material at least once in a $\beta$ phase region; and hot working same in said $\beta$ phase region or regions from a $\beta$ phase to an $\alpha$ phase, so that said titanium material has a tensile strength of 65 kgf/mm$^2$ or more.

In this present invention preferably the O and N contents are 0.03 or more and 0.002 or more, respectively.

DESCRIPTION OF THE PREFERRED EMBODIMENTS

Figure 1:
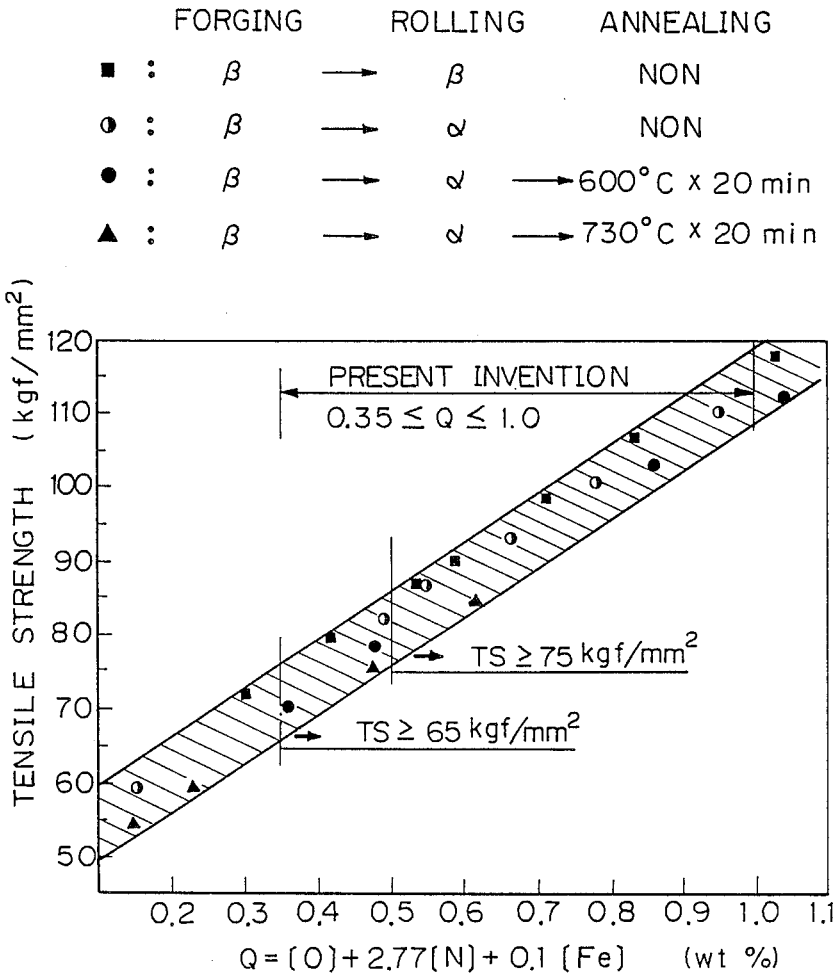
FIG. 1 shows a relationship between various Q values and the tensile strength.

Before describing the preferred embodiments of the invention, the basic technical concept of the present invention will be explained. To obtain a higher strength titanium material, two methods are well known, as follows;

One method is carried out by strengthening the solid solution of O and N as interstitial solid solution elements. Namely, an attempt is made to obtain a high strength by adding O and N having a larger content than the desired content, respectively, as explained hereinafter.

Nevertheless, since an excessive addition of O and N leads to a decrease of the ductility of the titanium material, this method is not preferable. Therefore, the contents of such interstitial elements must be within a suitable range, respectively.

The other method is carried out by refining crystal grains to obtain a high strength titanium material, which does not cause a decrease of the ductility by an excessive addition of O and N. The refining of grains by an impurity element Fe, which is a substitutional type, and a $\beta$ eutectoid type element effectively increases the strength. To make the refining of grains effective, the Fe content is preferably 0.1% or more by weight which is more than the solid solution maximum limit of Fe, i.e., about 0.06% by weight, in an $\alpha$ phase region thereof. A crystal grain size of a macrostructure of a titanium cast ingot is several tens of mm, e.g., 30 or 40 mm, and a macrostructure having such a crystal grain size is heated at a temperature higher than $\beta$ transus, and then hot workd in a $\beta$ phase region or regions from the $\beta$ phase and to an $\alpha$ phase. By this processing method, firstly, the crystal grain size of the macrostructure can be refined because of $\alpha$to $\beta$ phase transformation on heating up to the $\beta$ region, secondly the plastic deformation by hot working in the $\beta$ or $\beta$ to $\alpha$ region effectively makes the refinement of the grain size.

Since, in the present invention, Fe is contained in a range of from 0.1 to 0.8% by weight in a uniformly dispersed state, the macrostructure of the titanium cast ingot is changed to a fine-trained, two-phase lamellar structure by hot working in a $\beta$ phase region because of the phase transformation from recrystallized or nonrecrystallized $\beta$ phase to $\alpha$ phase (more precisely, to $\alpha + \beta$ phase). Even if such a lamellar structure is heated again for hot working, it exhibits a equiaxed two phase or lamellar-type fine grain structure, so that the structure is stabilized against a heat treatment for working. Thus, when the titanium cast ingot of the present invention is hot worked by forging and rolling, the ingot must be heated at least once to obtain a $\beta$ phase, and then hot worked. According to this method, even if a usual post-heat-treatment is carried out after a hot working, a remarkable change in the structure, e.g., an enlargement of the crystal grain size, is not easily generated, and thus stable mechanical properties can be obtained.

When a titanium cast ingot is always heated in an $\alpha$ phase region and immediately hot worked without heating in a $\beta$ phase region, which is the same as in the above method, surface chapping wrinkle defects and a macro segregation of the Fe concentration can not be prevented.

The range of each elements as defined in the present invention will be explained in detail, based on obtained data.

In the present invention 0.1 to 0.8% by weight of Fe is added to Ti.

Figure 3A:
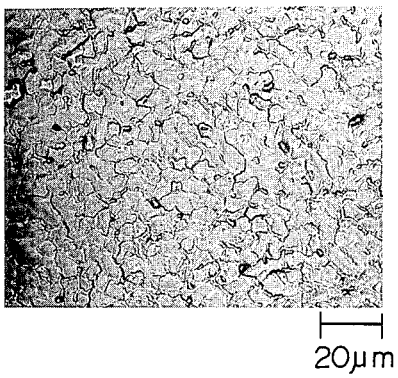
FIGS. 3A to 3D are photographs of the microstructure of materials when hot worked and annealed.

FIGS. 3A to 3D are photographs of the microstructure of the present invention in which 0.48% by weight of Fe is contained. Particularly, FIG. 3A shows at ×500, a microstructure hot worked from a cast ingot having a composition of Table 2 and having a diameter of 430 mm, which was forged in a $\beta$ phase region to form a forged article having a diameter of 100 mm, heated at a temperature of 950° C., and rolled in a $\beta$ phase region to form a titanium bar.

TABLE 2

| Chemical Composition (wt %) | | | | | |
|---|---|---|---|---|---|
| N | C | H | Fe | O | Ti |
| 0.099 | 0.012 | 0.005 | 0.48 | 0.193 | rest |

Figure 3B:
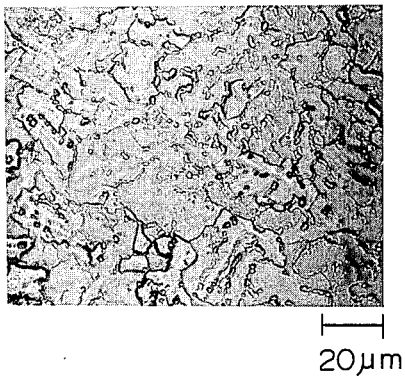

The microstructure of the as-rolled titanium bar having an Fe content of 0.48% by weight is a fine-grained two phase ($\alpha + \beta$) structure in a worked state. The microstructure shown in FIG. 3B is that of the above mentioned titanium bar having a diameter of 30 mm, after annealing in an $\alpha$ phase region obtained at 650° C. for one hour. As shown in FIG. 3B, even if the titanium having an Fe content of 0.48% by weight is annealed after hot working, i.e., rolling, the microstructure is not remarkably different from that of FIG. 3A, i.e., the crystal grain growth is prevented by the contained Fe, and a fine-grained microstructure is maintained.

Figure 3C:
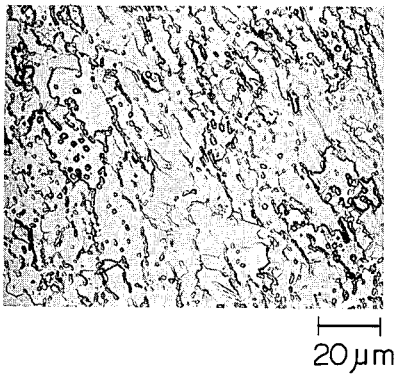

FIG. 3C shows a microstructure of a titanium bar having a diameter of 30 mm obtained by heating a forged article having a diameter of 100 mm in an $\alpha$ phase region (800° C.) and rolling. The titanium bar of FIG. 3C is not annealed after the hot rolling. The metal microstructure of FIG. 3C is a fine-grained two phase and lamellar structure which is very similar to those of FIGS. 3A and 3B. This means that the microstructure of the forged article having a diameter of 100 mm forged at a $\beta$ phase region was maintained by hot rolling in an $\alpha$ phase region.

Figure 3D:
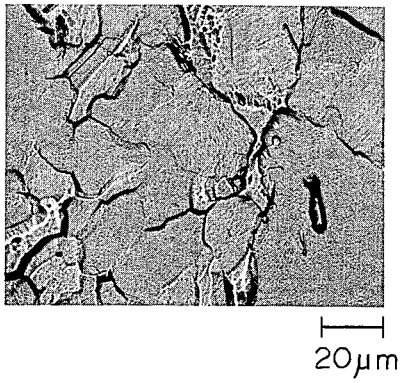

FIG. 3D shows a microstructure of a titanium bar having a diameter of 30 mm, obtained by rolling a 30 mm titanium cast ingot by the same process as explained in FIG. 3A.

This structure is a comparative example and shows a non uniform structure having some grain growth.

Further, the structure shown in FIG. 3D is unstable when given a post-heat-treatment, and showed a grain growth when the annealing temperature was high.

As apparent from the above explanation, when a titanium material containing, for example, 0.5% by weight of Fe is hot rolled in a $\beta$ phase region or in a phase from $\beta$ to $\alpha$, as described in an example, even if a heavy working process such as a process wherein a reduction ratio is remarkably increased is not carried out, a titanium material exhibiting a fine-grained metal microstructure can be obtained. Such fine-grained metal microstructure is not separated by a subsequent hot rolling in an $\alpha$ phase region and annealing, so that the structure is stably maintained. When 0.1% or more by weight of Fe is contained, such effect of Fe that the microstructure of the titanium bar is made fine-grained can be obtained. When 0.5% or more by weight of Fe is contained, this effect is remarkably enhanced.

The upper limit of Fe content is defined as 0.8% by weight in the present invention because, when Fe is contained at amount of more than 0.8% the effect of Fe is saturated, and further, an excess content of Fe lowers the ductility of the titanium bar.

In the present invention, the oxygen (O), nitrogen (N), and iron (Fe) contained in titanium (Ti) is controlled so that Q in the following expression, $$Q=[O]+2.77[N]+0.1[Fe],$$

ranges from 0.35 to 1.0

The control of each component is carried out by using all of the briquette units forming a consumable electrode used in a usual VAR, e.g., a consumable electrode type vacuum arc remelting. Namely, raw materials such as sponge titanium and others are uniformly mixed so that a required composition level can be obtained, and a briquette in produced by a machine, e.g., a hydraulic press, In the above expression, Q corresponds to an oxygen equivalence, the coefficients of [N] and [Fe] denote a strengthening ratio by a solid solution strengthening per a percentage by unit weight of O, and was obtained by the present inventors by a correlation data of various components to a mechanical property value. The coefficient of [Fe] is as small as 0.1 because, when Fe content is from 0.1% to 0.8% by weight, the solid solution-strengthening of the Fe is decreased.

Figure 2:
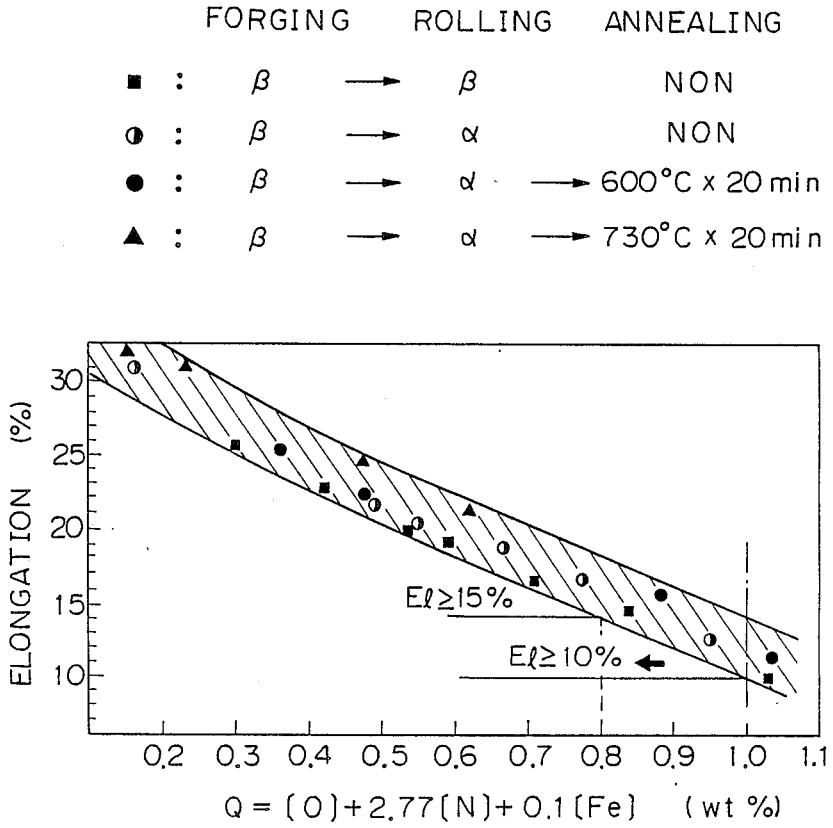
FIG. 2 shows a relationship between various Q values and the elongation.

FIGS. 1 and 2 show a relationship between the Q value and the mechanical properties of a titanium bar having an Fe content of 0.1 to 0.8% by weight. In this case a tensile test was carried out according to the ASTM standard. A titanium cast ingot having a diameter of 430 mm was forged and hot rolled to produce a bar material having a diameter of 10 to 30 mm. This forging or hot rolling was carried out at least once at a temperature of the $\beta$ phase region. In the slanted line area of FIGS. 1 and 2, the titanium bar as hot rolled or after the hot rolling, annealed at a temperature of 600° C. or 730° C. for 20 minutes and air cooled, is contained.

Particularly, FIG. 1 shows a relationship between the tensile strength and the Q values. All of the measured values are distributed in the slanted-line area, and the tensile strength and Q value has a significant relationship.

As shown in FIG. 1, when the Q value is 0.35 or more, a titanium bar having a tensile strength of 65 kgf/mm$^2$ or more can be obtained. Further, when the Q value is 0.5 or more, a tensile strength of 75 kgf/mm$^2$ or more can be obtained.

FIG. 2 shows a relationship between the elongation and the Q value of a titanium bar. When the Q value is increased the elongation is decreased. But, when the Q value is 0.8 or less, the elongation becomes 15% or more, and when the Q value is 1.0% or less, the elongation becomes 10% or more, which proves that the improved ductility of a titanium bar can be maintained. According to the present invention, the Q value is from 0.35 to 1.0. If the value is less than 0.35, a required tensile strength can not be obtained, and if the Q value is greater than 1.0, the ductility of the titanium bar is decreased.

Example

Examples of the present invention are shown in Table 3. Nos. 1 to 7 of Table 3 are examples of the present invention, and Nos. 8 to 10 are comparative examples.

The Titanium bar of Nos. 1 to 10 was obtained by forging a cylindrical cast ingot having a diameter of 430 mm into a forged article having a diameter of 100 mm, and hot rolling. The titanium bars of Nos. 1 to 4 having the same compositions and Q values were forged, hot rolling and heat treated (annealing) under different conditions. Nevertheless, the titanium bars of Nos. 1 to 4 have a high strengt and improved ductility, and the titanium bars of Nos. 5 to 7 have higher Fe an N contents than those of Nos. 1 to 4. When Fe content is high the microstructure becomes fine-grained and more uniform, whereby titanium bars having substantially the same mechanical properties are obtained. The comparative example No. 8 which has a low Fe content has a low tensile strength, and further, the comparative examples Nos. 9 and 10 have an excess Fe content and a low elongation rate. In examples Nos. 11 and 12 of the present invention, the N content is high and thus a tensile strength of from 90 to 100 kgf/mm$^2$ can be obtained.

TABLE 3

| No. | Composition (% by weight) Fe | O | N | Q | Forging | Rolling | Heat treatment*1 | Tensile strength (kgf/mm$^2$) | Elongation (%) |
|---|---|---|---|---|---|---|---|---|---|
| 1 | 0.21 | 0.31 | 0.05 | 0.47 | $\beta$ phase | $\beta$ phase | A | 77.0 | 24.0 |
| 2 | " | " | " | " | $\beta$ | $\beta \sim \alpha$ | None | 81.5 | 23.5 |
| 3 | " | " | " | " | $\beta \sim \alpha$ | $\beta \sim \alpha$ | None | 80.7 | 23.0 |
| 4 | " | " | " | " | $\beta \sim \alpha$ | $\alpha$ | B | 75.2 | 25.5 |
| 5 | 0.72 | 0.25 | 0.08 | 0.54 | $\beta$ | $\beta$ | A | 83.2 | 20.0 |
| 6 | " | " | " | " | $\beta \sim \alpha$ | $\beta \sim \alpha$ | A | 82.5 | 20.5 |
| 7 | " | " | " | " | $\beta$ | $\alpha$ | A | 82.0 | 20.8 |

TABLE 3-continued

| No. | Composition (% by weight) Fe | O | N | Q | Forging | Rolling | Heat treatment*1 | Tensile strength (kgf/mm$^2$) | Elongation (%) |
|---|---|---|---|---|---|---|---|---|---|
| 8*2 | 0.05 | 0.29 | 0.07 | 0.49 | $\beta$ | $\beta$ | A | 66.5 | 28.0 |
| 9*2 | 0.86 | 0.35 | 0.06 | 0.60 | $\beta$ | $\alpha$ | B | 84.0 | 14.0 |
| 10*2 | " | " | " | " | $\alpha$ | $\alpha$ | B | 82.2 | 13.5 |
| 11 | 0.51 | 0.20 | 0.18 | 0.75 | $\beta \sim \alpha$ | $\alpha$ | A | 94.0 | 19.0 |
| 12 | 0.52 | 0.22 | 0.23 | 0.85 | $\beta \sim \alpha$ | $\alpha$ | A | 106.0 | 13.2 |

*1A: 650° C. × 20 min Heating and Air-cooling
B: 730° C. × 20 min Heating and Air-cooling
None: As hot rolled
*2: Comparative Examples According to the present invention, a high strength titanium material can be obtained without the need for complicated hot working processes such as pre-setting and heavy plastic working. Further, according to the present invention, a high strength material having a tensile strength of 65 kgf/mm$^2$ or more, or 75 kgf/mm$^2$ or more, which has never been used before, can be produced. Still further, according to the present invention, a required high strength titanium material having an improved ductility can be produced in a hot rolled state without a post-heat-treatment.

The titanium materials obtained by the present invention can be used as a tube plate when in a heavy plate form, as a high tension bolt and an anchor bolt in a bar form, or as rope and eyeglass material when in a wire form.

We claim:

1. A high strength titanium material having improved ductility, containing 0.1 to 0.8% by weight of iron, a required oxygen and nitrogen satisfying the following expression, in which an oxygen equivalence Q ranges from 0.35 to 1.0.

$$Q = [O] + 2.77\,[N] + 0.1\,[Fe]$$

wherein

[O] is an oxygen content % by weight

[N] is a nitrogen content % by weight

[Fe] is an iron content % by weight the rest being titanium and inevitable impurities, said oxygen and nitrogen existing as interstitial type solute elements in said titanium material, said titanium material exhibiting a two phase, an equiaxed phase or a lamellar phase, fine grain microstructure and having a tensile strength at least 65 kgf/mm$^2$.

2. A high strength titanium material having an improved ductility according to claim 1, wherein said Q value is 0.35 to 0.8.

3. A high strength titanium material having an improved ductility according to claim 1, wherein said Q value is 0.5 to 1.0 and said tensile strength is 75 kgf/mm$^2$ or more.

* * * * *